US009840754B2

(12) United States Patent
Langlais et al.

(10) Patent No.: US 9,840,754 B2
(45) Date of Patent: Dec. 12, 2017

(54) ROTARY INJECTOR AND PROCESS OF ADDING FLUXING SOLIDS IN MOLTEN ALUMINUM

(71) Applicant: Rio Tinto Alcan International Limited, Montreal (CA)

(72) Inventors: Joseph Langlais, Saguenay (CA); Peter Donald Waite, Saguenay (CA); Francis Breton, Saguenay (CA); Serge Munger, Saguenay (CA)

(73) Assignee: Rio Tinto Alcan International Limited, Montreal (CA)

( * ) Notice: Subject to any disclaimer, the term of this patent is extended or adjusted under 35 U.S.C. 154(b) by 0 days.

(21) Appl. No.: 14/894,815

(22) PCT Filed: May 23, 2014

(86) PCT No.: PCT/CA2014/050476

§ 371 (c)(1),
(2) Date: Nov. 30, 2015

(87) PCT Pub. No.: WO2014/190430

PCT Pub. Date: Dec. 4, 2014

(65) Prior Publication Data

US 2016/0108496 A1 Apr. 21, 2016

Related U.S. Application Data

(60) Provisional application No. 61/828,215, filed on May 29, 2013.

(51) Int. Cl.
*C22B 9/10* (2006.01)
*C22B 21/06* (2006.01)
(Continued)

(52) U.S. Cl.
CPC ..... *C22B 21/062* (2013.01); *B01F 7/007* (2013.01); *B01F 7/021* (2013.01); *B01F 7/06* (2013.01);
(Continued)

(58) Field of Classification Search
CPC ..... C22B 21/062; C22B 9/103; B01F 7/007; B01F 7/021; B01F 7/06; F27D 27/00
See application file for complete search history.

(56) References Cited

U.S. PATENT DOCUMENTS 3,870,511 A 3/1975 Szekely
4,040,610 A 8/1977 Szekely
(Continued)

FOREIGN PATENT DOCUMENTS

CA 2209965 C 1/1998
CA 2272976 A1 11/1999
(Continued)

OTHER PUBLICATIONS

Schwart, Harold. ProKon. "Aluminum". Version 8.6 (1998) The Calculation Companion.*
(Continued)

*Primary Examiner* — George Wyszomierski
*Assistant Examiner* — Tima M McGuthry Banks
(74) *Attorney, Agent, or Firm* — Banner & Witcoff, Ltd.

(57) ABSTRACT

A rotary injector comprising an elongated shaft having a proximal end and a distal end, and an impeller at the distal end of the elongated shaft, the elongated shaft and the impeller being collectively rotatable during operation around an axis of the shaft, the rotary injector being hollow and having an internal supply conduit extending along the shaft and across the impeller, the supply conduit having an inlet at the proximal end of the shaft, a main portion extending from the inlet to a discharge portion, the discharge
(Continued)

portion extending to an axial outlet, the discharge portion having a narrow end connecting the main portion of the supply conduit and a broader end at the axial outlet.

32 Claims, 20 Drawing Sheets

(51) Int. Cl.

| | |
|---|---|
| ***B01F 7/00*** | (2006.01) |
| ***B01F 7/02*** | (2006.01) |
| ***B01F 7/06*** | (2006.01) |
| ***F27D 27/00*** | (2010.01) |
| ***C22C 1/06*** | (2006.01) |
| ***C22C 21/00*** | (2006.01) |
| ***F27D 3/00*** | (2006.01) |

(52) U.S. Cl.
CPC ..... *C22B 9/103* (2013.01); *C22C 1/06* (2013.01); *C22C 21/00* (2013.01); *F27D 3/0033* (2013.01); *F27D 27/00* (2013.01)

(56) References Cited

U.S. PATENT DOCUMENTS

| | | | | |
|---|---|---|---|---|
| 5,080,715 | A * | 1/1992 | Provencher | C22B 21/064 266/217 |
| 5,413,315 | A | 5/1995 | Venas et al. | |
| 6,106,588 | A | 8/2000 | Skibo et al. | |
| 6,589,313 | B2 | 7/2003 | Bilodeau et al. | |
| 8,025,712 | B2 | 9/2011 | Dupuis et al. | |
| 2002/0088307 | A1* | 7/2002 | Bilodeau | C22B 21/062 75/528 |
| 2002/0096810 | A1 | 7/2002 | Bilodeau et al. | |
| 2003/0020585 | A1 | 1/2003 | Staker et al. | |
| 2003/0205854 | A1 | 11/2003 | Bilodeau et al. | |
| 2004/0021257 | A1* | 2/2004 | Bertherat | C22B 9/05 266/216 |
| 2010/0052227 | A1* | 3/2010 | Neff | C21C 1/06 266/217 |

FOREIGN PATENT DOCUMENTS

| | | | |
|---|---|---|---|
| EP | 0395138 | A1 | 10/1990 |
| EP | 0620285 | A1 | 10/1994 |
| EP | 1462530 | A1 | 9/2004 |
| WO | 2004/029307 | A1 | 4/2004 |

OTHER PUBLICATIONS

Aug. 18, 2014—International Search Report for PCT/CA2014/050476.

May 11, 2015—IPRP Chapter II for PCT/CA2014/050476.

Muntean et al., "Development of a Swirling Flow Apparatus for Analysis and Development of Swirling Flow Control", 3rd German-Romanian Workshop on Turbomachinery Hydrodynamics, May 10-12, 2007, pp. 41-54.

Salim, Basharat, "Effect of Geometerical Parameters on the Performance of Wide Angle Diffusers", International Journal of Innovative Research in Science, Engineering and Technology, vol. 2, Issue 9, Sep. 2013, pp. 4178-4191.

Skorve, Torill RÄ,dland, "Experimental and Theoretical Study on the Effect of Wall Roughness on the phenomenon "End of the Vortex" in Swirl Tubes", Master Thesis in Process Technology, Nov. 2011, all pages.

Jan. 11, 2017—(EP) Extended Search Report—App BR086769/AGO/AL.

* cited by examiner

Description for each step of the RFI for Test No.7

| Time (minutes) | |
|---|---|
| 0 - 6 | • The RFI begins its preheating cycle.<br>• Temperature variation measured during this period is caused by the equipment reaching equilibrium. The initial metal temperature is ≈ 755 °C. |
| 6 - 8 | • Gas (nitrogen) circulates through the RFI shaft.<br>• The shaft is submerged in liquid aluminum.<br>• Gas pressure increases from 0 to 3.5 PSI. |
| 8 - 11 | • Gas continues to circulate in the shaft. The RFI starts rotating to stir the molten metal.<br>• Temperature decreases as metal is homogenized.<br>• The furnace burner is turned off to allow metal sampling.<br>• Pressure in the shaft remains constant. |
| 11 - 22 | • Salts in injected by the RFI.<br>• Temperature continues to decrease.<br>• Pressure increases slightly (up to 3.6 PSI) due to salt injection and remains constant. |
| 22 - 25 | • Salt injection is finished.<br>• Pressure decreases in the RFI salt as it comes out of the metal and the gas is stopped. |

FIG. 16

ROTARY INJECTOR AND PROCESS OF ADDING FLUXING SOLIDS IN MOLTEN ALUMINUM

CROSS-REFERENCE TO RELATED APPLICATIONS

The present application is a U.S. National Phase filing of International Application No. PCT/CA2014/050476, filed on May 23, 2014, designating the United States of America and claiming priority to U.S. Patent Application No. 61/828,215, filed May 29, 2013, and this application claims priority to and the benefit of the above-identified applications, which are both incorporated by reference herein in their entireties.

FIELD

The improvements generally relate to a process and apparatus for adding particulate solid material to a liquid, and can more particularly be applied to a process and apparatus for the addition of particulate fluxing to aluminum in melting and holding furnaces.

BACKGROUND

Rotary injectors were used to treat molten aluminum, such as disclosed in U.S. Pat. No. 6,589,313 for instance. In these applications, a rotary injector, known as a rotary flux injector, was used to introduce salts into molten aluminum held in a large volume furnace.

An example of a known rotary flux injector is shown in FIG. 1 as having a rotary shaft 15, typically made of a temperature resistant material such as graphite, leading to an impeller mounted to the end thereof. A supply conduit is provided within the rotary injector, extending along the shaft and leading to an axial outlet across the impeller. A fluxing agent, typically in the form of a mixture of particulate salts, is entrained along the supply conduit by a carrier gas. The impeller has a disc shape with blades or the like to favour the mixing of the fluxing agent in the molten metal, in an action referred to as shearing.

Known rotary flux injectors were satisfactory to a certain degree. Nonetheless, because the fluxing time limited the productivity of furnaces, it remained desirable to improve the shearing efficiency, with the objective of reducing fluxing time and improving productivity. Moreover, the efficiency of rotary flux injectors was limited by occurrences of blockage of the supply conduit which was known to occur especially at lower molten aluminum temperatures (e.g. below 705-720° C.). Henceforth, rotary flux injectors were not used until the molten aluminum reached a certain temperature threshold, and this heating period was thus not productive from the standpoint of fluxing.

SUMMARY

The cause of the systematic low temperature blockage was identified as being the formation of a plug of metal, by contrast with the formation of a plug of salts.

It was found that providing the discharge portion of the supply conduit with a truncated conical shape could address the occurrences of systematic low temperature blockage caused by the formation of a plug of metal, thus allowing to use the rotary flux injector earlier which reduced overall treatment time and improved productivity.

Moreover, it was surprisingly found that providing the discharge portion of the supply conduit with a truncated conical shape with a sharp edge could lead to a significant increase in the shearing efficiency, thereby providing an even further improvement in productivity. It is believed that this improvement in shearing efficiency can find utility in other applications than fluxing aluminum, and more specifically in processes for adding particulate solid materials or mixing gasses with other metals than aluminum, or even in liquids which are not molten metals.

Henceforth, in accordance with one aspect, there is provided a rotary injector comprising an elongated shaft having a proximal end and a distal end, and an impeller at the distal end of the elongated shaft, the elongated shaft and the impeller being collectively rotatable during operation around an axis of the shaft, the rotary injector being hollow and having an internal supply conduit extending along the shaft and across the impeller, the supply conduit having an inlet at the proximal end of the shaft, a main portion extending from the inlet to a discharge portion, the discharge portion extending to an axial outlet, the discharge portion having a narrow end connecting the main portion of the supply conduit and a broader end at the axial outlet.

In accordance with another aspect, there is provided a process of treating molten aluminum using a rotary injector, the process comprising: introducing a head of the rotary injector into the molten aluminum; while the head of the rotary injector is in the molten aluminum, entraining particulate treatment solids along a supply conduit along a shaft of the rotary injector and out from the head of the rotary injector, while rotating an impeller at the head of the rotary injector; and reducing the speed of the particulate treatment solids at a discharge portion of the supply conduit by an increase in the cross-sectional surface area of the supply conduit.

Many further features and combinations thereof concerning the present improvements will appear to those skilled in the art following a reading of the instant disclosure.

DESCRIPTION OF THE FIGURES

In the figures,

FIG. 16 is a description of steps of the test of FIG. 15;

In the above figures, the acronym RFI refers to Rotary Flux Injector.

DETAILED DESCRIPTION

Figure 1:
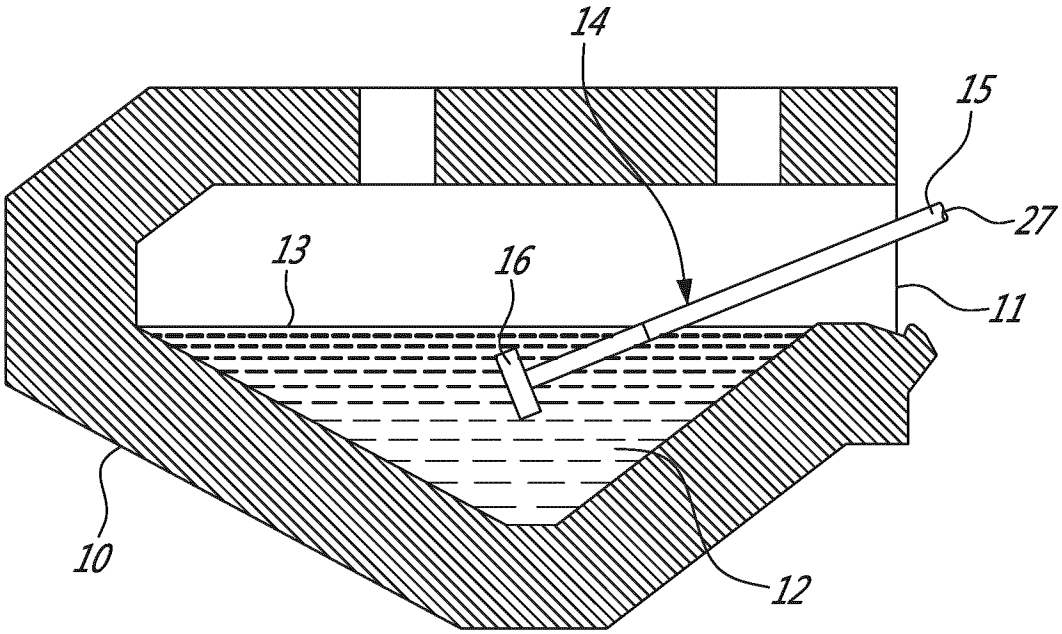
FIG. 1 Prior Art
FIG. 1 is a schematic view showing a rotary injector in use in molten aluminum held in a furnace.

Referring to FIG. 1, a large aluminum melting furnace 10 has a side opening 11 and contains a bath of molten aluminum 12 with a melt surface 13. Extending through the opening 11 is a rotary injector 14 having an elongated shaft 15 having a shaft axis, a proximal end 27 and an opposite distal end, and an impeller 16 mounted on the distal end of the shaft 15. A supply conduit (not shown) extends internally along the entire length of the shaft to an axial outlet across the impeller 16. During use, particulate fluxing solids are entrained along the supply conduit of the shaft 15 by gasses, into the molten metal bath 12. During use, the shaft 15 and the impeller 16 rotate while the particulate fluxing solids are injected into the molten metal bath 12. Henceforth, the particulate fluxing solids are dispersed in the liquid aluminum both by the speed at which they exit the distal end of the shaft, and by the rotation of the impeller which produces a shearing effect. The fluxing solids can be used to reduce alkali metals and particulate in large aluminum smelting and holding furnaces, for instance.

Figure 3:
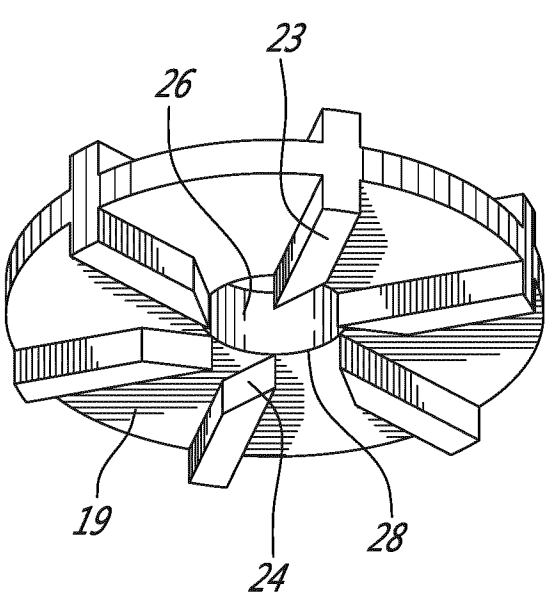
FIG. 3 Prior Art
FIG. 2 and FIG. 3 are two different oblique views showing an example of an impeller.
Figure 2:
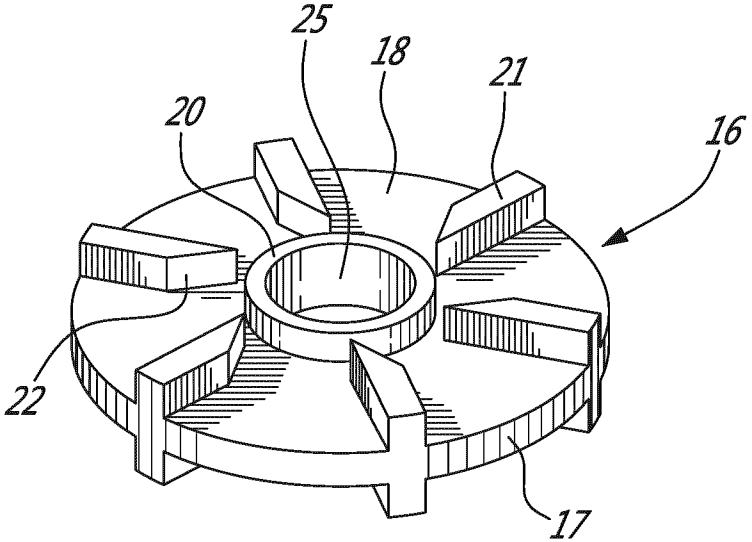
FIG. 2 Prior Art

One embodiment of an impeller 16 which can be selectively mounted or dismounted to a shaft is shown in greater detail in FIGS. 2 and 3. Providing the impeller as a separate component from the shaft can be advantageous in the case of components made of graphite. In this embodiment, the impeller 16 has a threaded socket 25 on one side to securely receive the distal end of the shaft 15, and has an aperture 26 leading to a circular outlet edge 28 of the supply conduit on the other side. The impeller 16 comprises a disc-shaped plate 17, typically about 40 cm in diameter, having an axial opening surrounded by a collar 20 for mounting to the shaft 15. The plate 17 has a proximal face 18 receiving the shaft 15 and a distal face 19. Fixed on the proximal face 18 are a plurality of radially mounted blades 21 having tapered inner end faces 22. The inner ends of these blades 21 are preferably terminated at a radial distance greater than the radius of the collar 20 to provide an annular gap between the collar and the inner edges of the blades. Fixed to the lower face of plate 17 are a further series of radially mounted blades 23 having tapered inner end faces 24. The impeller, in use, is preferably rotated so that the tapered inner end faces 22 are on the side of the blades opposite the direction of rotation. With this impeller arrangement, the solids/gas mixture is fed along the supply conduit in the shaft 15 and through collar opening 20 at which point the lower blades 23 serve to mix the solids/gas mixture with the molten metal. Where the solid is a salt flux, it is molten by the point at which it enters the molten aluminum and is readily sheared into small droplets by the blades 23 to effectively distribute them. The disc-shaped impeller can have more than one superposed plates in alternate embodiments.

Figure 4:
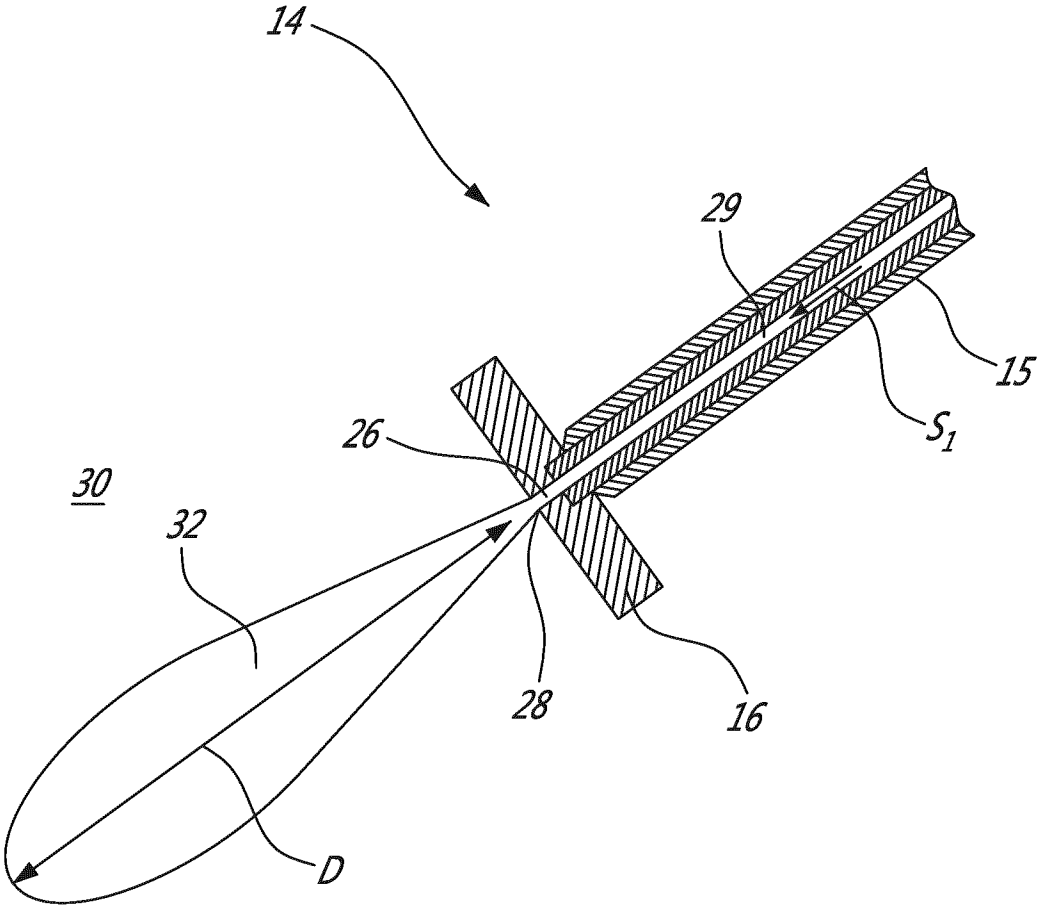
FIG. 4 is a schematic cross-sectional view of a rotary injector during use.

FIG. 4 schematizes a rotary flux injector 14 with the impeller 16 mounted to the shaft 15 during operation in molten aluminum 30. The internal supply conduit 29 extends in an elongated cylindrical manner along the shaft 15 and leads to a circular outlet end 28. The particulate material is entrained at a speed $S_1$ in the supply conduit which is strongly dependent upon the velocity of the carrier gas. The particulate material is expulsed from the outlet end 28 and forms a cloud 32 in the molten aluminum 30. The depth D of the cloud 32 is directly related to the speed $S_1$ in the supply conduit and the viscosity of the molten aluminum 30. The rotary flux injector 14 is rotated while the particulate material is added, in a manner that the rotation of the impeller 16 favours the mixing, or shearing of the particulate material into the molten aluminum.

Figure 5:
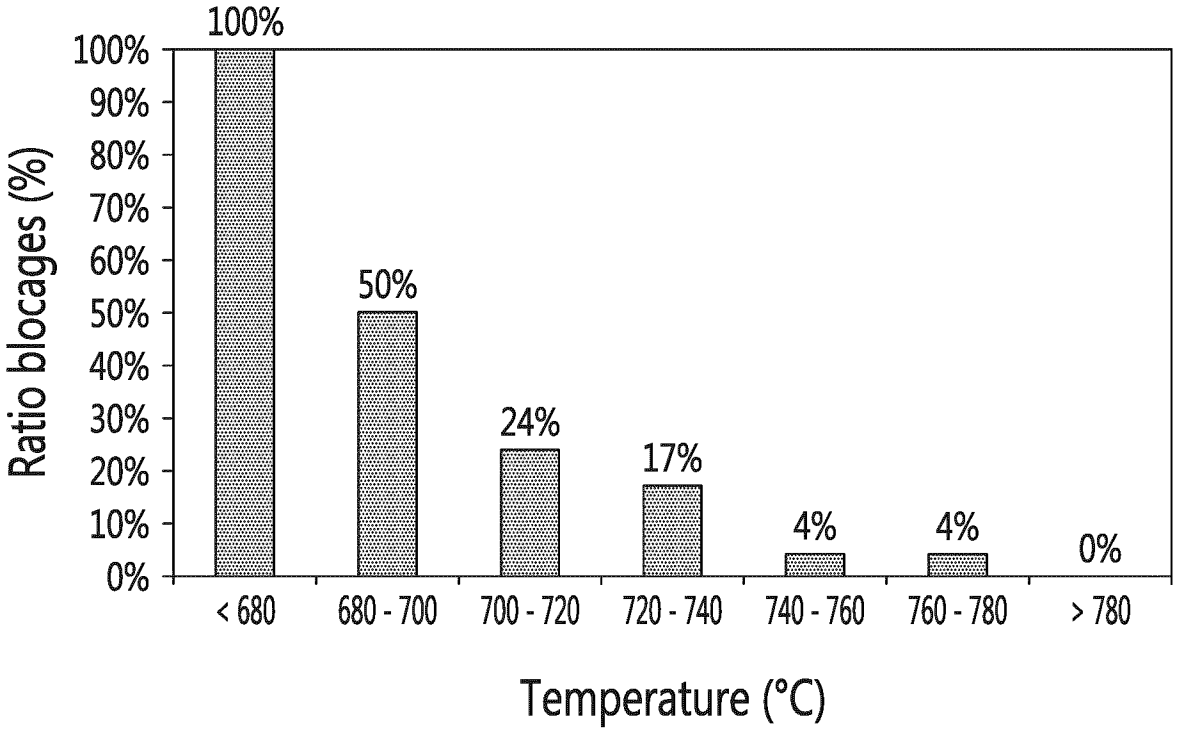
FIG. 5 is a graphical representation showing the relationship between blockage ratio and temperature of the molten aluminum.

Using rotary flux injector such as described above, it was found that significant clogging problems were encountered at low temperatures, to the point of restricting the use of the apparatus. Studies were carried out and it was found that the clogging was due to the formation of a plug of metal at the discharge portion of the supply conduit. Indeed, it was found that when cold metal, for example at a temperature less than about 705-720° C., comes into contact with the shaft, it solidifies and forms a plug thereby significantly reducing and interrupting the fluxing treatment. This is especially significant when the shaft is made of a heat conducting material such as graphite which can drain heat from the molten metal at a significant rate. The relationship between blockage occurrences and the temperature of molten aluminum is exemplified in the graph provided at FIG. 5.

In the production of some alloys, such as the 5000 aluminum series for instance, the fluxing time can be significant, such as more than one hour for instance, which has a direct impact on the furnace cycle. To reduce the impact of fluxing on the cycle time, it can be desired to pre-flux, a practice which consists in doing a portion of the fluxing while the liquid metal is being loaded into the furnace. Using a rotary flux injector in pre-fluxing was found problematic due to the blocking issues. For alloys in the 5000 series, the fluxing temperatures were between 740 and 750° C. whereas the pre-fluxing is carried out at temperatures between 680 and 700° C.

Figure 6B:
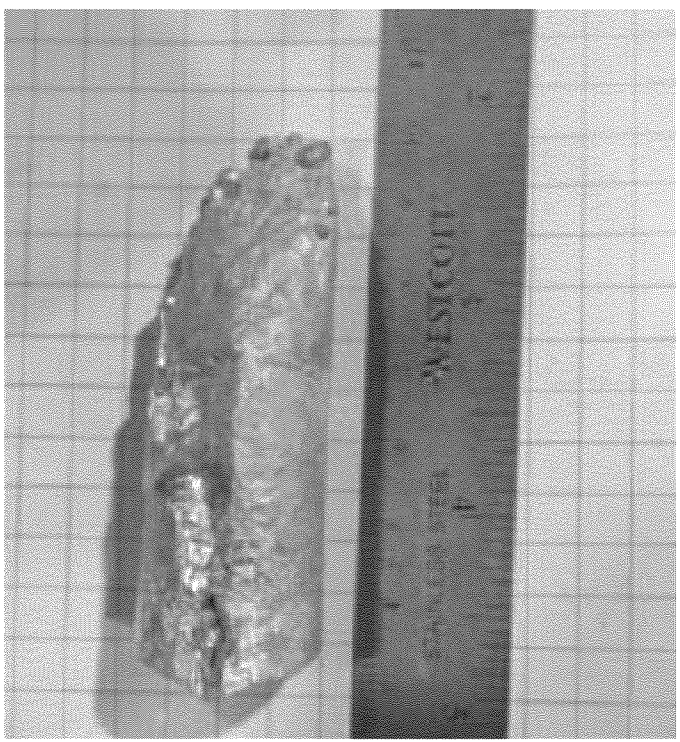
FIGS. 6A and 6B are photographs of plugs obtained during use of the rotary injector at low temperatures.
Figure 6A:
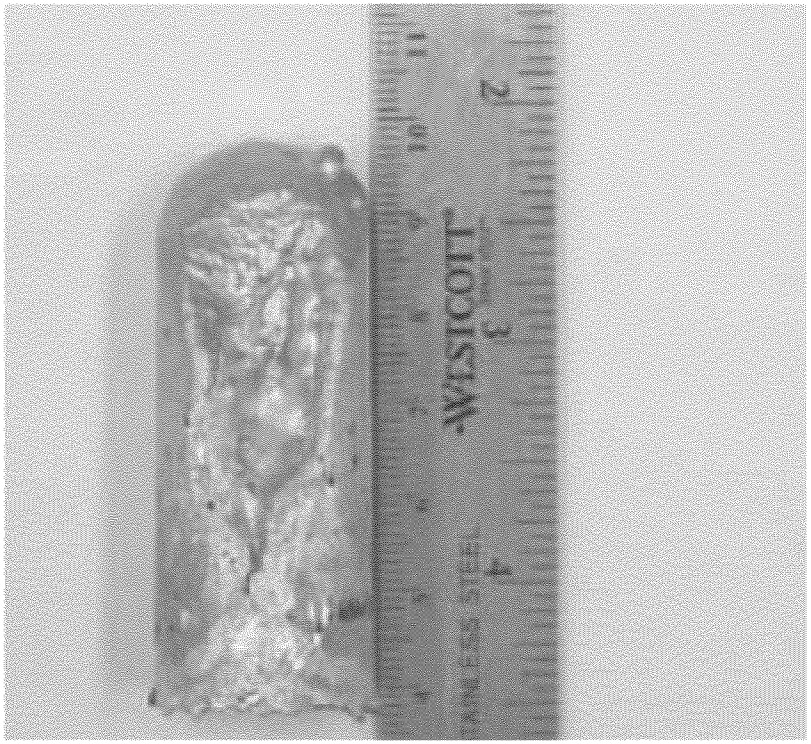

Tests were made using a typical rotary flux injector such as shown in FIG. 4. This led to observing occurrences of somewhat cylindrical metal plugs shown in FIGS. 6A and 6B. More precisely, the metal plug in FIG. 6A was obtained from a test conducted at a molten metal temperature of 679° C. with a gas flow rate of 60 L/min at 30 PSI, whereas the metal plug in FIG. 5B was obtained at molten metal temperature of 680° C. with a gas flow rate of 100 L/min.

More specifically, it is understood that upon insertion of the shaft into the molten metal, the static metallic pressure allows aluminum to penetrate into the discharge portion of the supply conduit. The graphite shaft forms a heat sink which solidifies the metal within the discharge portion.

Figure 7:
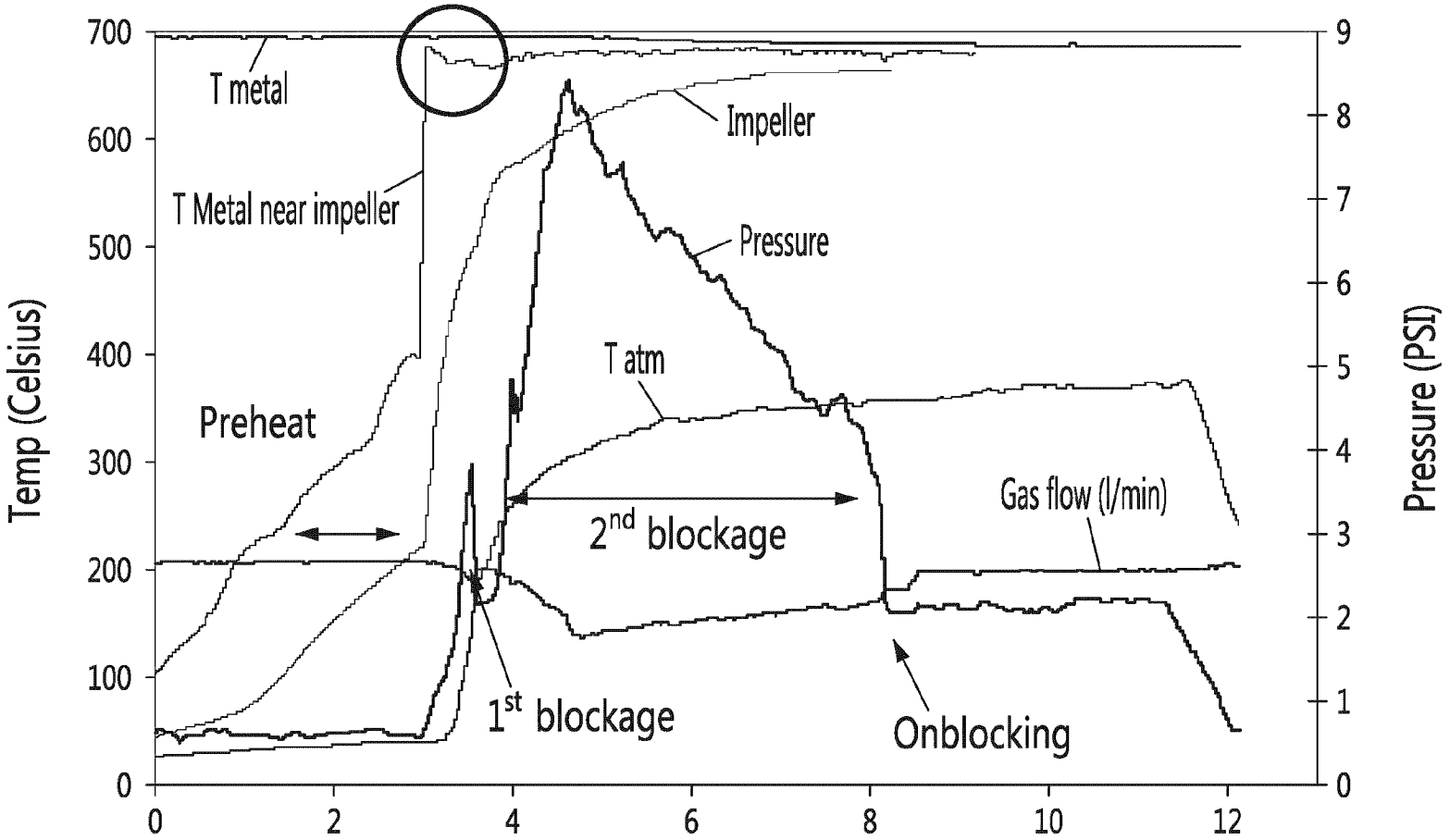
FIG. 7 is a detailed graphical representation of the evolution of the temperature at different locations during operation of the rotary injector.

The blockage mechanism is shown in FIG. 7. The temperature of the metal close to the shaft and pressure of the gas injected by the rotary flux injector follow a specific tendency. During the insertion of the shaft into the molten metal, the temperature close to the impeller falls rapidly due to the heat sink formed by rotary flux injector. This temperature drop causes solidification of the metal in the discharge portion of the supply conduit. This leads to an increase of the pressure in the nitrogen supply system. The formation of the metallic plug involves two steps prior to the complete unblocking of the shaft and of the return to normal injection pressure.

Figure 8:
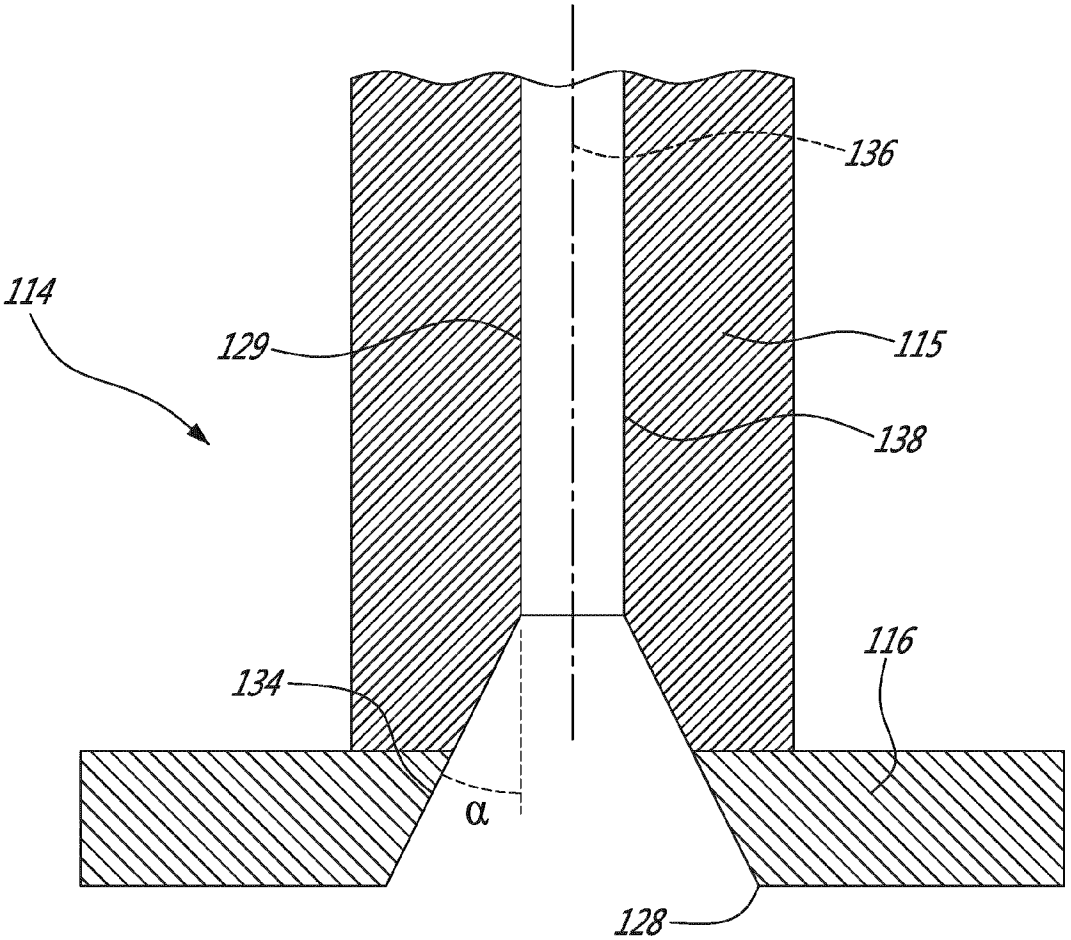
FIG. 8 is a schematic cross-sectional view of a rotary injector having a broadening discharge portion to the supply conduit.

An alternate embodiment of a rotary flux injector 114 schematized in FIG. 8 was produced. In this alternate embodiment, the rotary flux injector 114 has a broadening discharge portion 134 having an angle α relative to the rotation axis 136. The broadening discharge portion 134 extends from an outlet 128 to a cylindrical main portion 138 of the supply conduit 129, across both the impeller 116 and a portion of the shaft 115 along a given length. The broadening discharge portion 134 can be seen in this case to have a truncated conical shape broadening out toward the outlet 128 and form a sharp edge with the distal face of the impeller at the outlet 128. Such as shown more clearly in FIGS. 21B and 22, the impeller 116 has a disc-shaped plate 117 having a distal face 119 and blades 125 protruding axially from the distal face 119. More specifically, in this embodiment, the blades 125 can be said to extend from a transversal plane 140 coinciding with the distal face 119, on a side of the transversal plane 140 which is opposite to the shaft.

It was found that using a broadening discharge portion 134 having a sharp edge can not only allow to address the occurrences of blockages at low temperatures, but can surprisingly also increase the shearing efficiency.

Example 1

Figure 9:
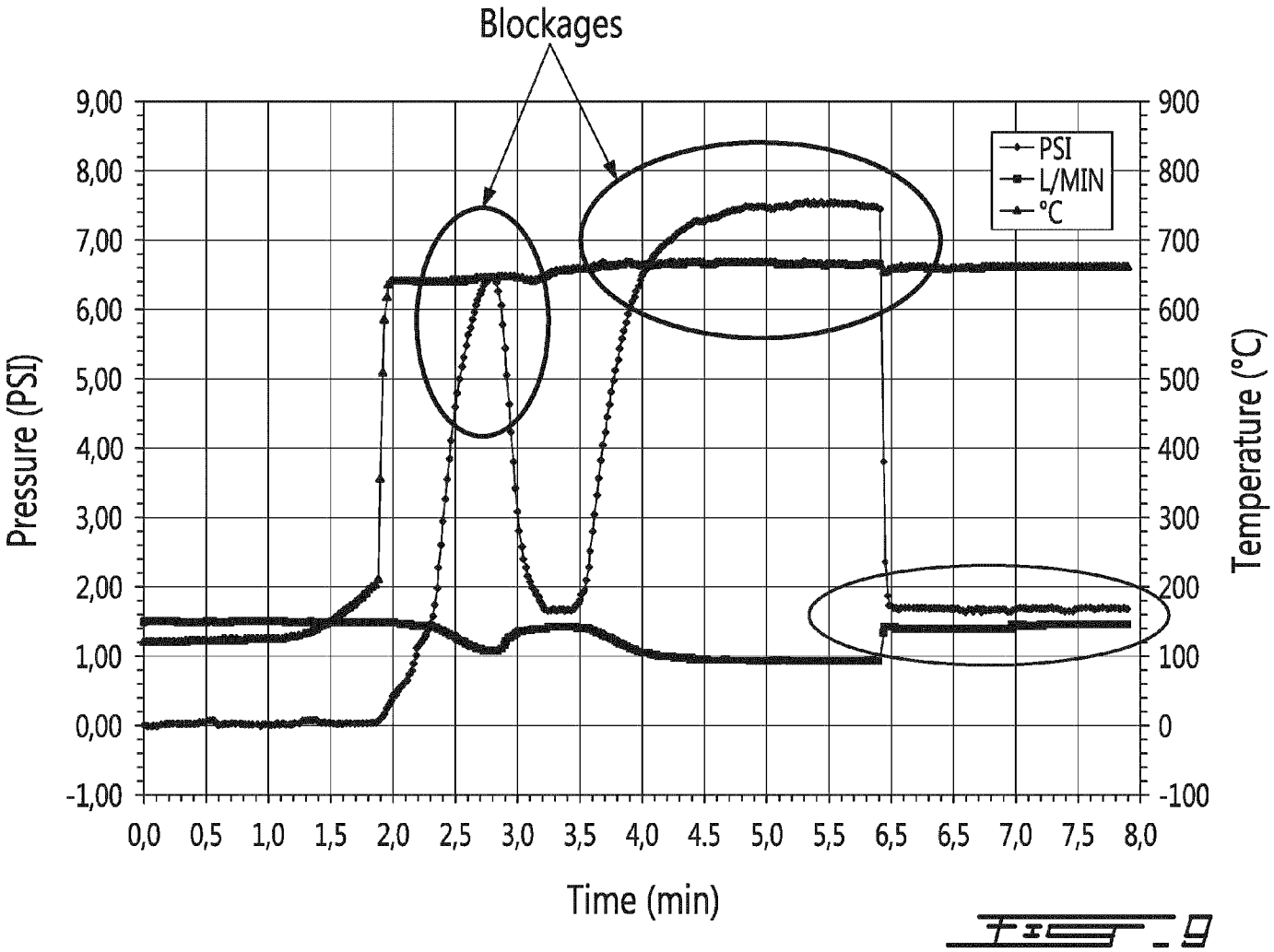
FIG. 9 is a detailed graphical representation of the use of a rotary injector such as shown in FIG. 8.

Tests were conducted with the rotary flux injector 114. In this first example, the angle α of the discharge portion was of 10°, with the discharge portion diameter being of ⅞" at its connection with the main portion of the supply conduit, and broadening out in a truncated conical fashion along a length of the of 3 inches, to a diameter of 2⅛" at the sharp outlet. 6 tests were conducted at 680° C. and nitrogen flow rate of 150 L/min in a 6-ton furnace. A typical result set is illustrated in FIG. 9. Two successive blockages are also visible in these tests, however none of these tests led to a permanent blockage. The metal plugs are expelled when the temperature rises. Henceforth, using a programming loop detecting the final unblocking of the shaft, it would be possible to flux at low temperature. Such programming can also reduce the risk of plugging of the salt supply network since the salt injection would only commence after confirmation that the metal plug is expelled.

Figure 11:
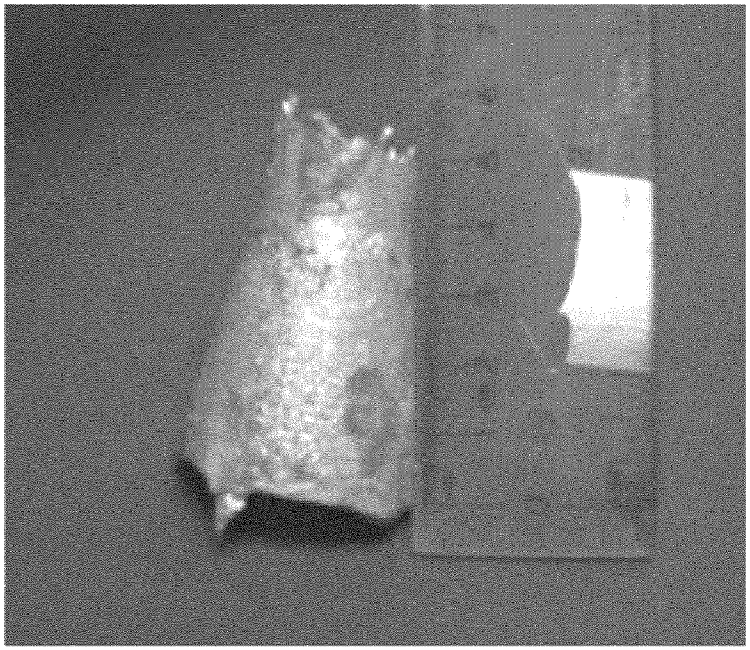
FIGS. 10 and 11 are photographs showing a conical plug obtained by voluntarily interrupting the use of the rotary injector of FIG. 8 upon detection of a temporary plug using the information from FIG. 9.
Figure 10:
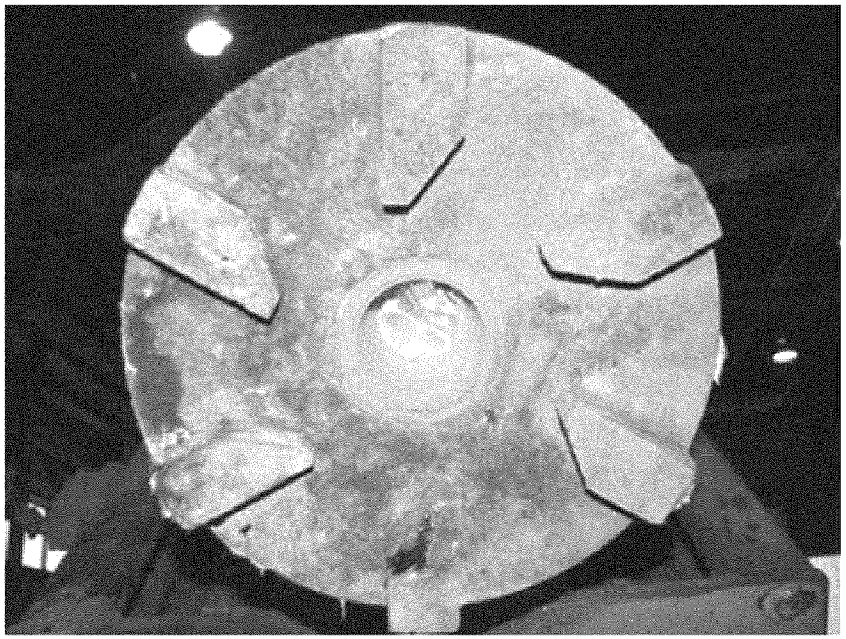

A seventh test was conducted which was interrupted during the blockage and in which the metal plug was retrieved. The metal plug is illustrated at FIGS. 10 and 11. This shows that a truncated conical portion of the discharge portion of the shaft having a few centimeters in length was sufficient to form the shape of the plug which could be more easily expelled. If the temperature of the metal is too low to allow re-melting of the plug, the impeller can be unplugged automatically during the fluxing step at higher temperatures.

Figure 12:
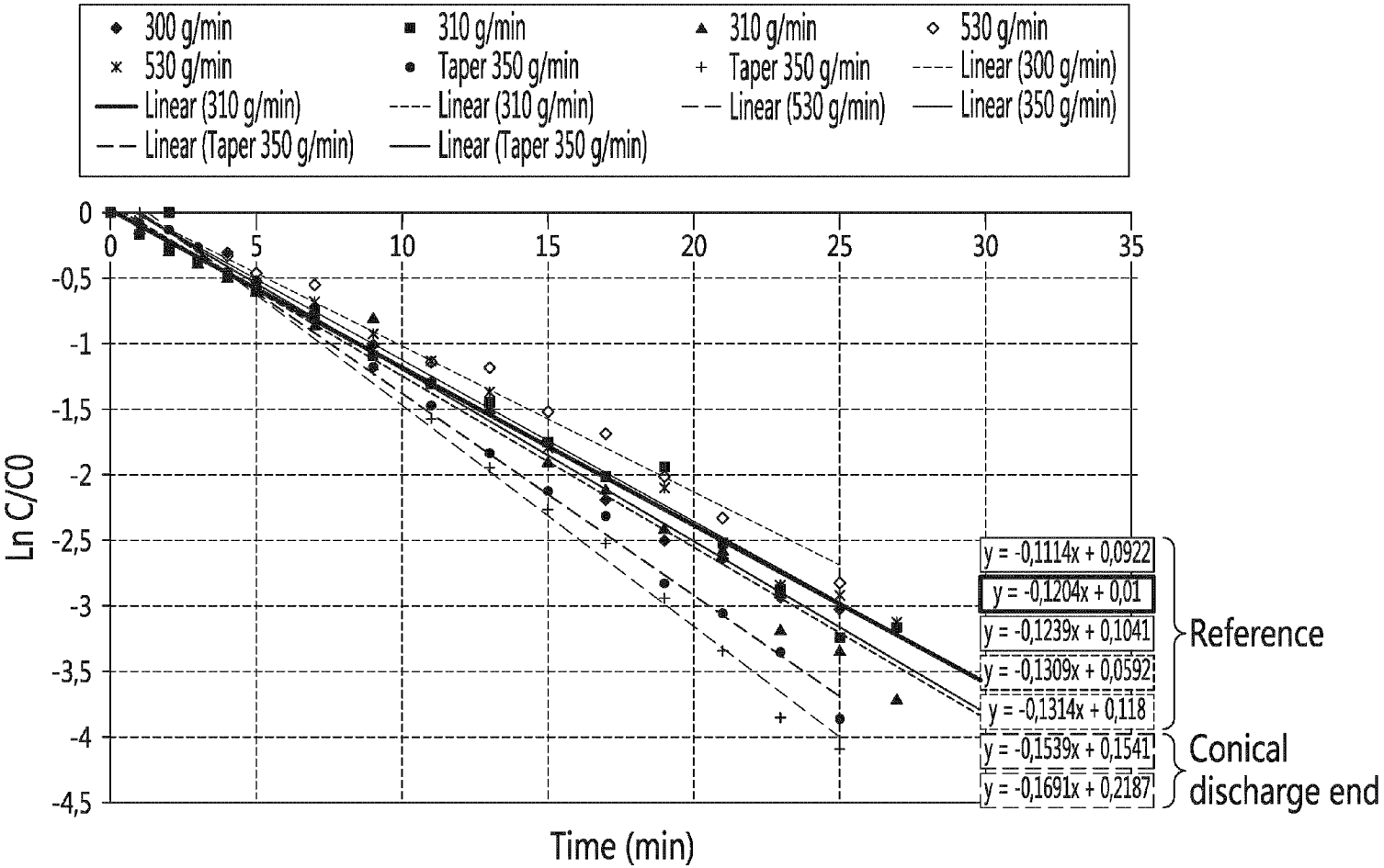
FIG. 12 is a detailed graphical representation illustrating variations in shearing efficiency.

To determine the impact of this change of shape on the dynamics of alkali removal from molten metal, calcium removal curves were drawn, these curves are illustrated at FIG. 12. Moreover, table 1 below demonstrates the differences of tests using a broadening discharge portion with tests using the same impeller but with the former cylindrical extension of the supply conduit as the discharge portion.

TABLE 1

Comparison between traditional rotary flux injector and rotary flux injector having truncated-conical discharge portion

| Type of rotary flux injector | Kinetic constant ($min^{-1}$) | Standard deviation |
|---|---|---|
| Traditional with continuous cylindrical discharge portion | 0.1236 | 0.0083 |
| With truncated-conical discharge portion with sharp outlet edge | 0.1615 | 0.0107 |

Surprisingly, it was found that using a truncated-conical shape of the discharge portion with a sharp outlet edge not only facilitated the removal of the metal plug but could also provide, at least in this test environment, the unexpected advantage of improving the kinetics of the treatment of the metal (fluxing).

Figures 21A, 21B, 21C:
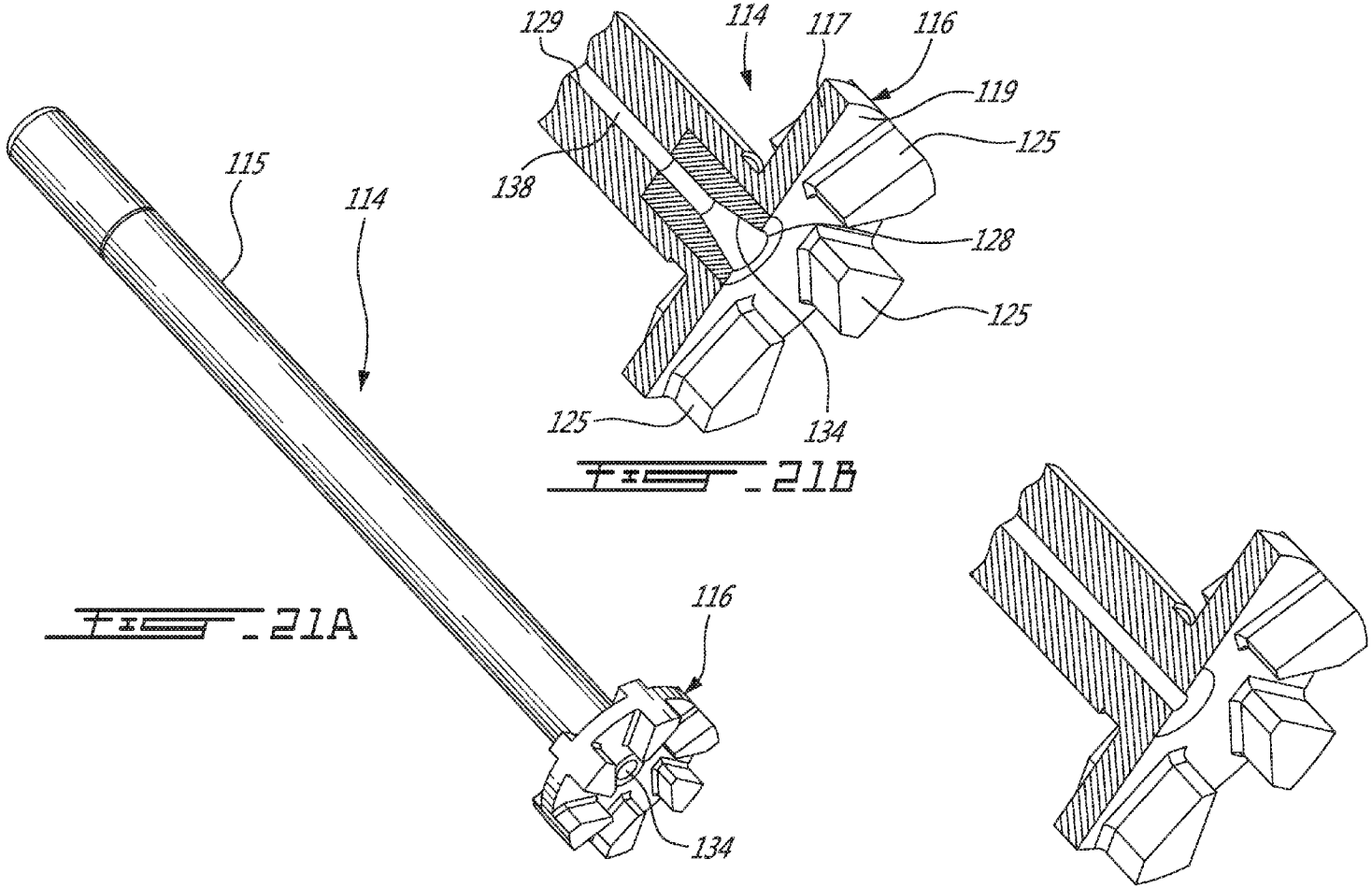
FIG. 21 is a schematic view showing operation of a rotary injector such as shown in FIG. 8.

The rotary injectors used for the tests summarized in Table 1 are shown in FIGS. 21A to 21C. More specifically, FIGS. 21A and 21B show the rotary injector with the discharge portion with a sharp outlet edge, whereas FIG. 21C shows the rotary injector with the continuous cylindrical discharge portion.

Example 2

Figure 13A:
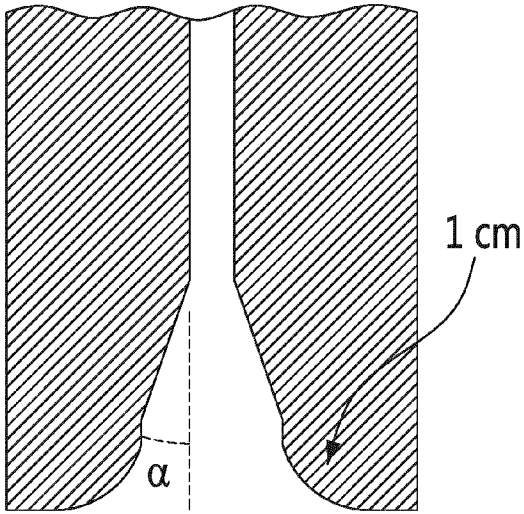
FIGS. 13A to 13C are schematic cross-sectional views of alternate embodiments of broadening discharge portion shapes for rotary injectors.

Tests were conducted with discharge portion of the shaft having the same length and angle than the one described in Example 1 above, but where the outlet edge was rounded with a 1 cm radius such as shown in FIG. 13, rather than being sharp.

Figure 14:
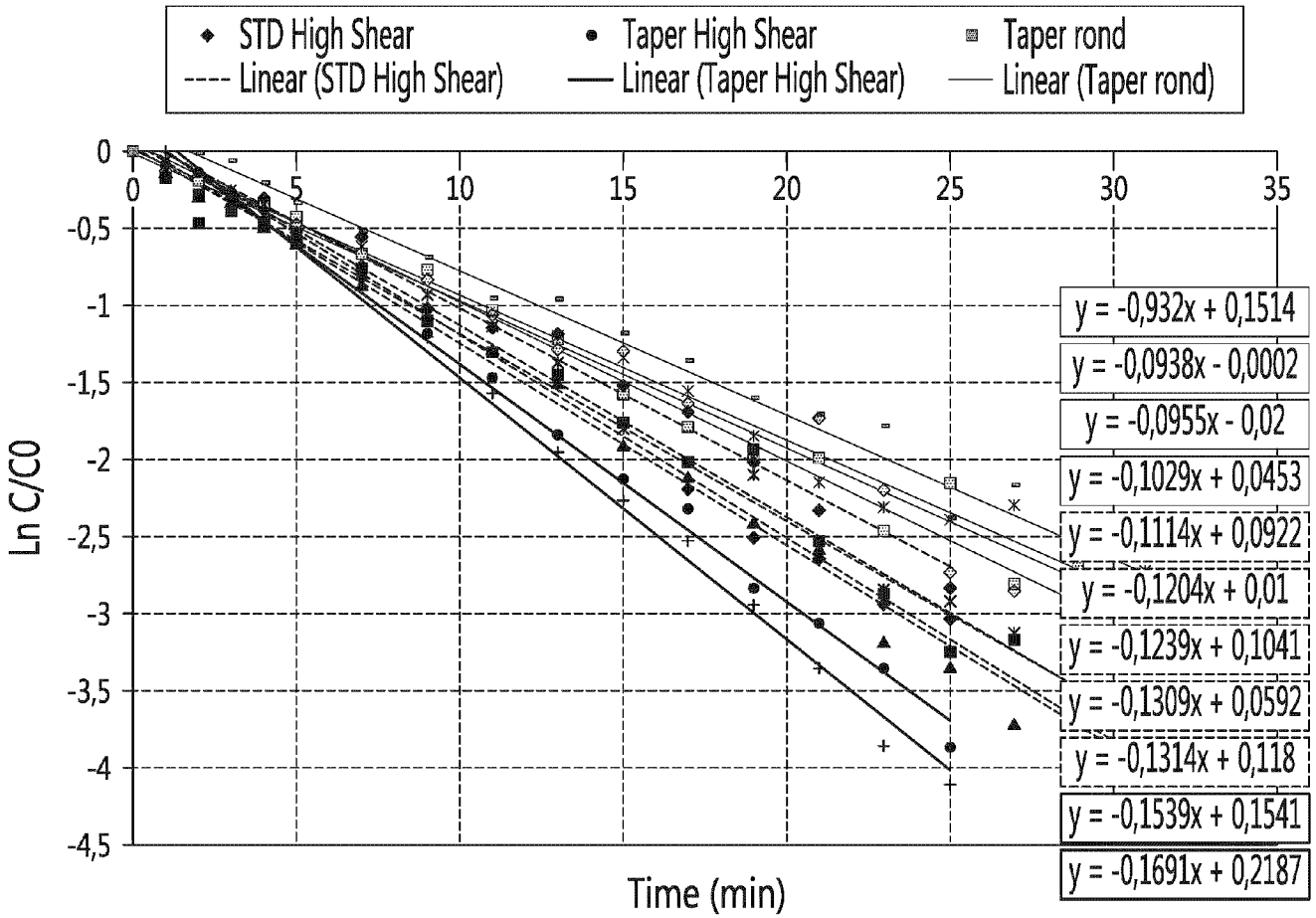
FIG. 14 is a detailed graphical representation illustrating variations in shearing efficiency.

More specifically, tests were done in the same 6-ton furnace, with a nitrogen flow rate of 150 L/min, and a salt flow rate of 350 g/min. An initially determined calcium concentration of 15 ppm was added to the molten metal in the 6 ton furnace before each of the tests. The results are presented in FIG. 14, and summarized in Table 2 below.

TABLE 2

Comparison between traditional rotary flux injector, rotary flux injector having a broadening discharge portion with a sharp outlet edge, and rotary flux injector having discharge portion with a rounded outlet edge

| Type of rotary flux injector | Kinetic constant ($min^{-1}$) | Standard deviation |
|---|---|---|
| Traditional with continuous cylindrical discharge portion | 0.1236 | 0.0083 |
| With discharge portion with sharp outlet edge | 0.1615 | 0.0107 |
| With discharge portion with 1 cm radius rounded outlet edge | 0.0964 | 0.0045 |

It was found that the alkali removal kinetics (shearing efficiency) decreased significantly with this configuration (broadening discharge portion having sharp edges). It is believed that this diminution of efficiency can be explained at least in part by the Coanda effect. By following the surface of the discharge portion, the trajectory of the salt becomes radial. The salt is sheared by the impeller, but it is propulsed more rapidly to the surface of the molten metal, reducing its residence time in the molten metal. Observations of large accumulations of liquid salt at the surface of the metal appears to confirm this theory. These large accumulations of liquid salt were not present in the other results presented at Table 1. Accordingly, it was concluded that the sharp edges of the oultet, i.e. a radius significantly smaller than one cm, are an advantageous feature in better achieving the benefits of the improvements.

Example 3

21 tests were carried out using a shaft having a truncated-conical shaped discharge portion having a diameter extending from 2.2 cm at its junction with the main portion of the supply conduit to 5.4 cm at a sharp circular outlet edge thereof, along an axial length of 7.62 cm.

Tests for parallel fluxing include 8 of the 21 tests. It consisted of fluxing during the charging of the last potroom crucible. The fluxing period for these tests always started as soon as the furnace reached a total of 90 tonnes of aluminum to ensure that the rotor is submerged in liquid metal.

The measurements taken during parallel fluxing tests were:

- Pressure in the rotary injector shaft.
- Metal temperature using the furnace thermocouple and a thermocouple connected to a "Hioki" receiver.
- Metal samples used to measure sodium concentrations by spectroscopy.

The 13 other fluxing tests were done during the standard fluxing practice. Only metal samples were taken during these tests.

Metal samples for both tests (parallel fluxing and regular fluxing) were taken as follows:

- One metal sample was taken moments before the fluxing started.
- Once the fluxing had started, metal samples were taken every two minutes for the next 10 minutes.
- Afterwards, metal samples were taken every five minutes for the remaining fluxing time (typically, five minutes, for the parallel fluxing and 25 minutes, for the standard practice).

To compare the sodium removal rates, the kinetic constants were calculated for each test and compared to those obtained from previous experimentation.

It is sought to reduce the impact of the rotary injector treatment on the overall furnace cycle time. Three methods were studied to achieve this goal:

- Operate the rotary injector in parallel with other furnace operations.
- Eliminate the rotary injector blockage at low temperature to operate earlier in the furnace cycle.
- Reduce the fluxing time.

Characterization of the Rotary Injector Blockage Cycle when Operating Earlier in the Furnace Cycle Experimentation to characterize the rotary injector blocking cycle was done on eight different occasions. Table 3 summarizes general information concerning each test.

TABLE 3

General information concerning the blocking characterization tests

| Test | Initial metal temperature (° C.) | Blockage | Fluxing |
|---|---|---|---|
| 1 | 742 | No | Yes |
| 2 | 705 | Yes (1) | Yes |
| 3 | 760 | No | Yes |
| 4 | 713 | Yes (2) | No |
| 5 | 769 | No | Yes |
| 6 | 767 | No | Yes |
| 7 | 755 | No | Yes |
| 8 | 770 | No | Yes |

Experimentations showed that in this context, a rotary injector shaft has a 5% chance to block when submerged in metal over 720° C. The probability to block increases as the temperature decreases. During the tests outlined above, only two tests out of the eight had an initial metal temperature low enough to block the rotary injector (Tests 2 and 4). Even though metal temperatures over 720° C. allow fluxing opportunities, the rare blocking events limited the number of analyses that could be done.

However, lower metal temperatures were measured more frequently in previous experimentations. The higher metal temperatures measured in this experimentation are suspected to be caused by a better crucible management, reducing the metal heat loss before pouring it in the furnace.

Figure 15:
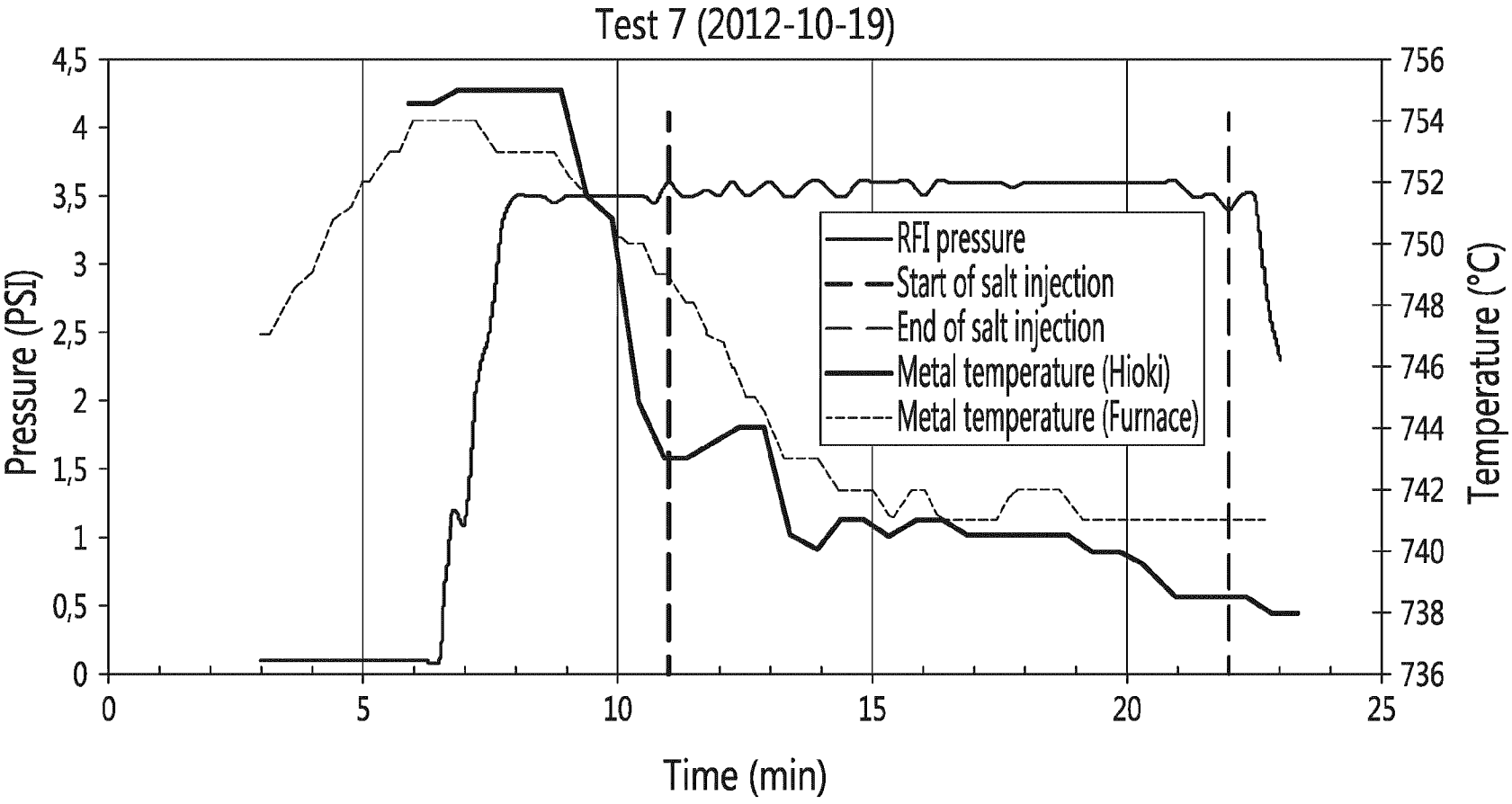
FIG. 15 is a graphical representation of a test.

An example using Test No. 7 shows graphically the typical measurements obtained when metal temperatures are higher than 720° C. in FIG. 15. A detailed explanation of the steps for Test No. 7 are provided in FIG. 16.

Figure 17:
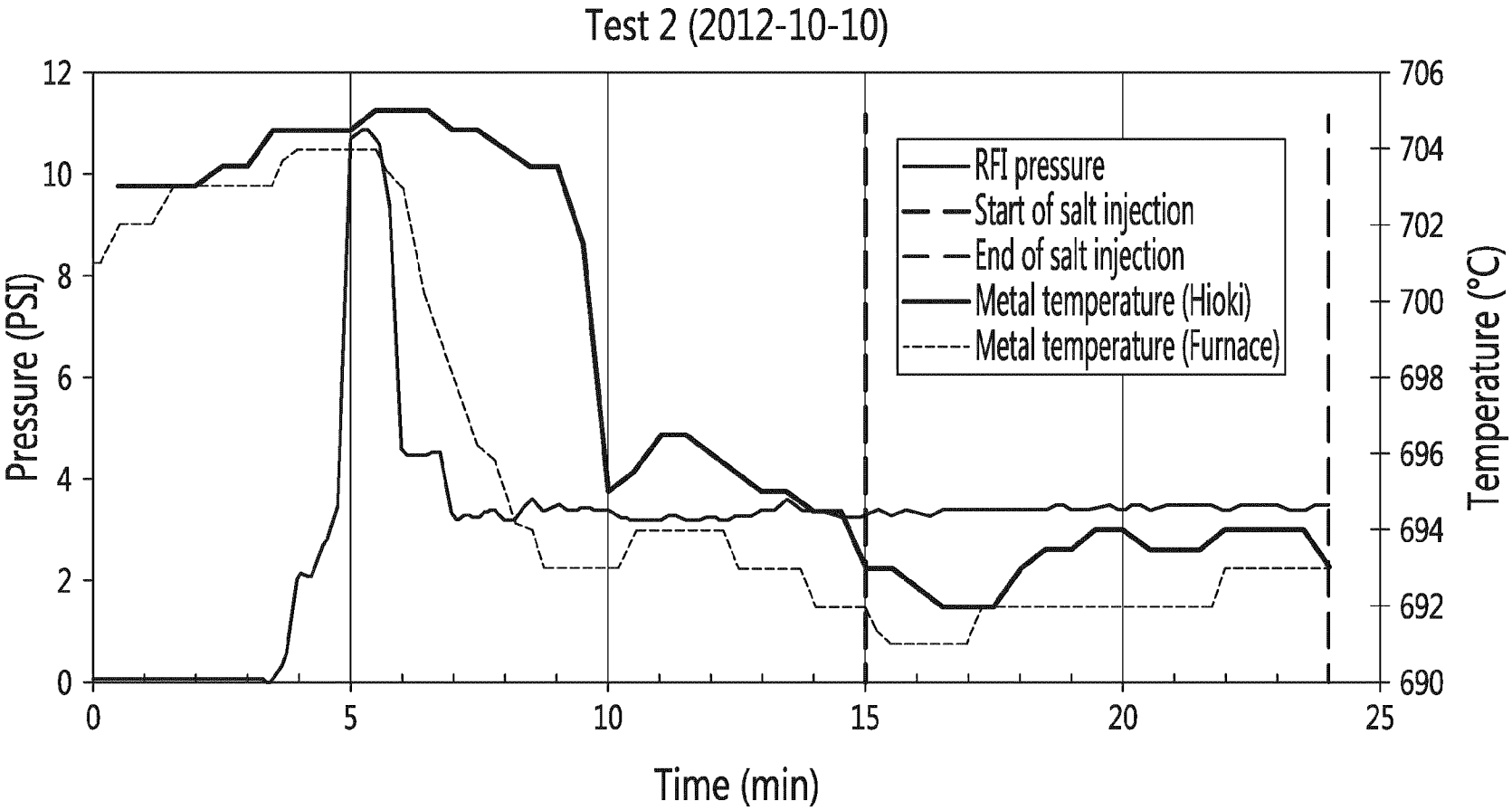
FIG. 17 is a graphical representation of another test.

Tests Nos. 2 and 4 had conditions to block the rotary injector shaft. Measurements for Test No. 2 are shown graphically in FIG. 17.

For this particular test No. 2, the initial metal temperature (≠705° C.) is significantly lower than the other tests. The increase in pressure from 3.5 to ≈11 PSI, after 4 minutes, characterizes the solidification of molten aluminum in the shaft. The following decrease in pressure indicates that the metal was expulsed and the shaft unblocked. The following test measurements are similar to the other tests without blockage, and fluxing was successfully completed during the $15^{th}$ and $24^{th}$ minute of the test.

Finally, the blocking characterization was limited by the number of occasions to test the blockage.

Sodium Removal Rate Analysis when Fluxing Earlier in the Furnace Cycle

To evaluate the fluxing efficiency, the kinetic constant k ($min^{-1}$) was calculated for each fluxing test. The higher the value, the faster the sodium concentration will decrease and therefore, the more efficient the rotary injector treatment is. The reference constant value used is 0.04 $min^{-1}$ from previous measurements.

The following equation describes the sodium removal rate:

$$\frac{c}{c_0} = e^{-kt}$$

Where:

| | |
|---|---|
| $c_0$ | Is the initial sodium concentration (ppm). |
| c | Is the sodium concentration (ppm) at a given time t. |
| t | Is the time (minutes) |
| k | Is the kinetic constant ($min^{-1}$) |

The kinetic constants calculated for parallel fluxing were unreliable due to many furnace activities happening. These activities continuously change the metal's sodium concentration, interfering with the sodium removal rate calculation. For example, when solid metal melts or liquid metal is poured into the furnace. Table 4 below shows the information taken for each test including the calculated kinetic constant k.

TABLE 4

Kinetic values and other related information for each parallel fluxing test

| Test | Initial sodium (ppm) | Final sodium (ppm) | Kinetic constant K (min−1) |
|---|---|---|---|
| 1 | 8.5 | 3.4 | 0.068 |
| 2 | 9.6 | 6.3 | 0.037 |
| 3 | 8.5 | 6.6 | 0.025 |
| 4 | N/A | N/A | N/A |
| 5 | 8.0 | 4.1 | 0.053 |
| 6 | 7.3 | 4.1 | 0.031 |
| 7 | 0.3 | 0.3 | 0.012 |
| 8 | 12.8 | 7.85 | 0.041 |

To increase the precision of the sodium removal rate calculation, testing was continued but this time without any sodium concentration interference. To do so, more fluxing tests were done during the standard fluxing period (after alloying).

Sodium Removal Rate Analysis During Standard Fluxing Practice

Previous experimentation showed an increase of the rotary injector sodium removal rate when fluxing with the tapered shaft. To measure the removal rate, kinetic constants were calculated for more fluxing tests that were done during the standard fluxing practice. Information concerning all 13 tests is shown in Table 5 below.

TABLE 5

Kinetic values and other related information for each parallel fluxing test

| Test | Alloy Series | Initial sodium (ppm) | Final sodium (ppm) | Kinetic constant K ($min^{-1}$) | $R^2$ |
|---|---|---|---|---|---|
| 1 | 5XXX | 1.2 | 0.1 | 0.0394 | 0.71 |
| 2 | 3XXX | 2.8 | 0.3 | 0.0961 | 0.95 |
| 3 | 3XXX | 0.4 | N/A | 0.0918 | 0.37 |
| 4 | 3XXX | 4.3 | 0.3 | 0.0738 | 0.87 |
| 5 | 3XXX | 5.5 | 0.5 | 0.1015 | 0.97 |
| 6 | 3XXX | 5.2 | 0.7 | 0.0831 | 0.96 |
| 7 | 3XXX | 0.9 | N/A | N/A | N/A |
| 8 | 3XXX | 1.2 | 0.1 | 0.1052 | 0.87 |
| 9 | 3XXX | 6.5 | 1.15 | 0.0484 | 0.97 |
| 10 | 3XXX | 4.1 | 0.1 | 0.0358 | 0.91 |
| 11 | 3XXX | 1.5 | 0.09 | 0.0722 | 0.97 |
| 12 | 3XXX | 0.6 | 0.2 | 0.0514 | 0.93 |
| 13 | 5XXX | 4.5 | N/A | 0.0522 | 0.98 |

Thirteen fluxing tests were done, however, Tests Nos 1, 3 and 7 have not been considered because the sodium concentrations were too low and caused spectroscopy measurements to be unreliable. Many tests have a very high alkali removal rate value which is about twice the value of the reference data. It is believed that the tapered rotary injector shaft slows the gas flow rate and allows more salt to flow through the rotary injector rotor. Therefore, shearing is increased, and the kinetic of the reaction is increased.

Figure 18:
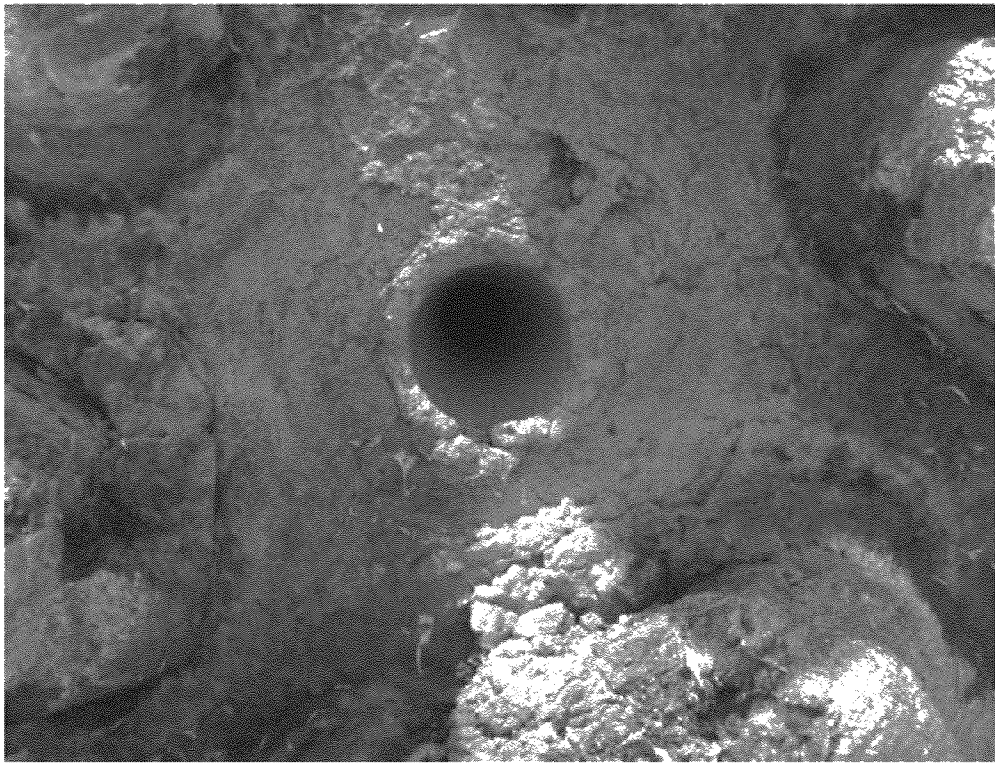
FIG. 18 is a photograph showing experimental results.

However, the obtained kinetic values are separated into two different groups. In fact, Test No. 9 shows a kinetic constant very different from the preceding tests and has a value similar to that of reference data ($k \approx 0.04$ $min^{-1}$). For this particular experiment, the salt flow rate in the rotary injector was slower than usual. Afterwards, observations showed that the tapered shaft was partially clogged with metal treatment residues. Tests following this event (10 to 13) all show kinetic constants that are significantly lower than the first eight tests. FIG. 18 presents the partially clogged tapered rotary injector shaft after Test No. 9.

As seen in FIG. 18, metal treatment residues solidified and covered the surface of the tapered section of the shaft. The extremity of the tapered shaft reduced in diameter by about 25% (from 5.4 to 4 cm). This obstruction seems to reduce the effectiveness of the new shaft design.

Figure 19:
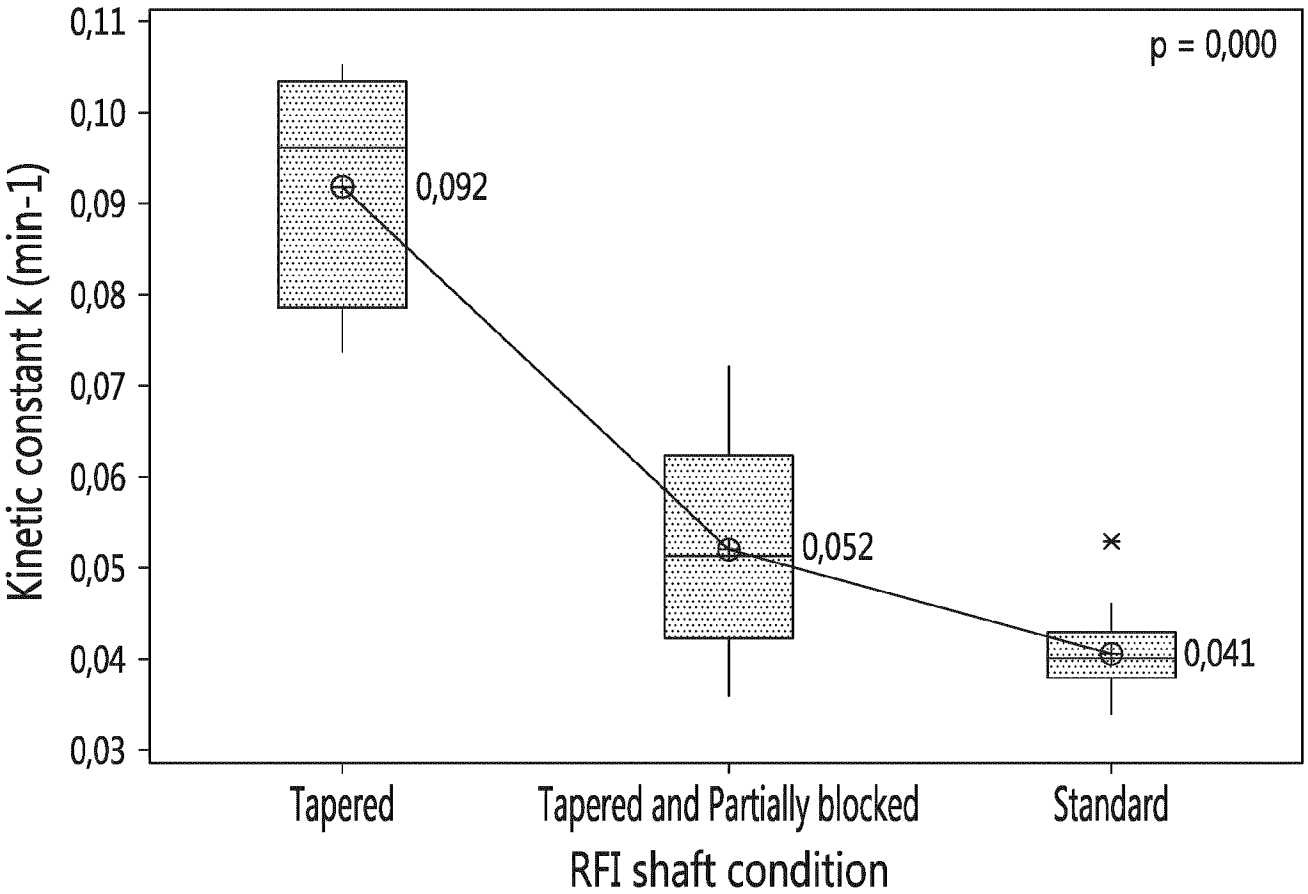
FIG. 19 is a graph showing experimental results.

FIG. 19 compares three groups of kinetic constants obtained when testing. The first group is composed of kinetic constant values for measurements taken while fluxing with the tapered shaft (Tests Nos. 1 to 8). The second group is kinetic constants when the tapered shaft was partially blocked (Tests Nos. 9 to 13). The last group is reference data from previous testing when fluxing with the standard rotary injector shaft.

As shown in FIG. 19, the new tapered shaft has an average kinetic value of 0.092 $min^{-1}$, which is slightly more than double the kinetic value obtained when using the standard rotary injector shaft. This improvement signifies that the rotary injector treatment is twice as rapid, reducing the amount of time and salt needed by half to meet the same final sodium concentrations.

Figure 20:
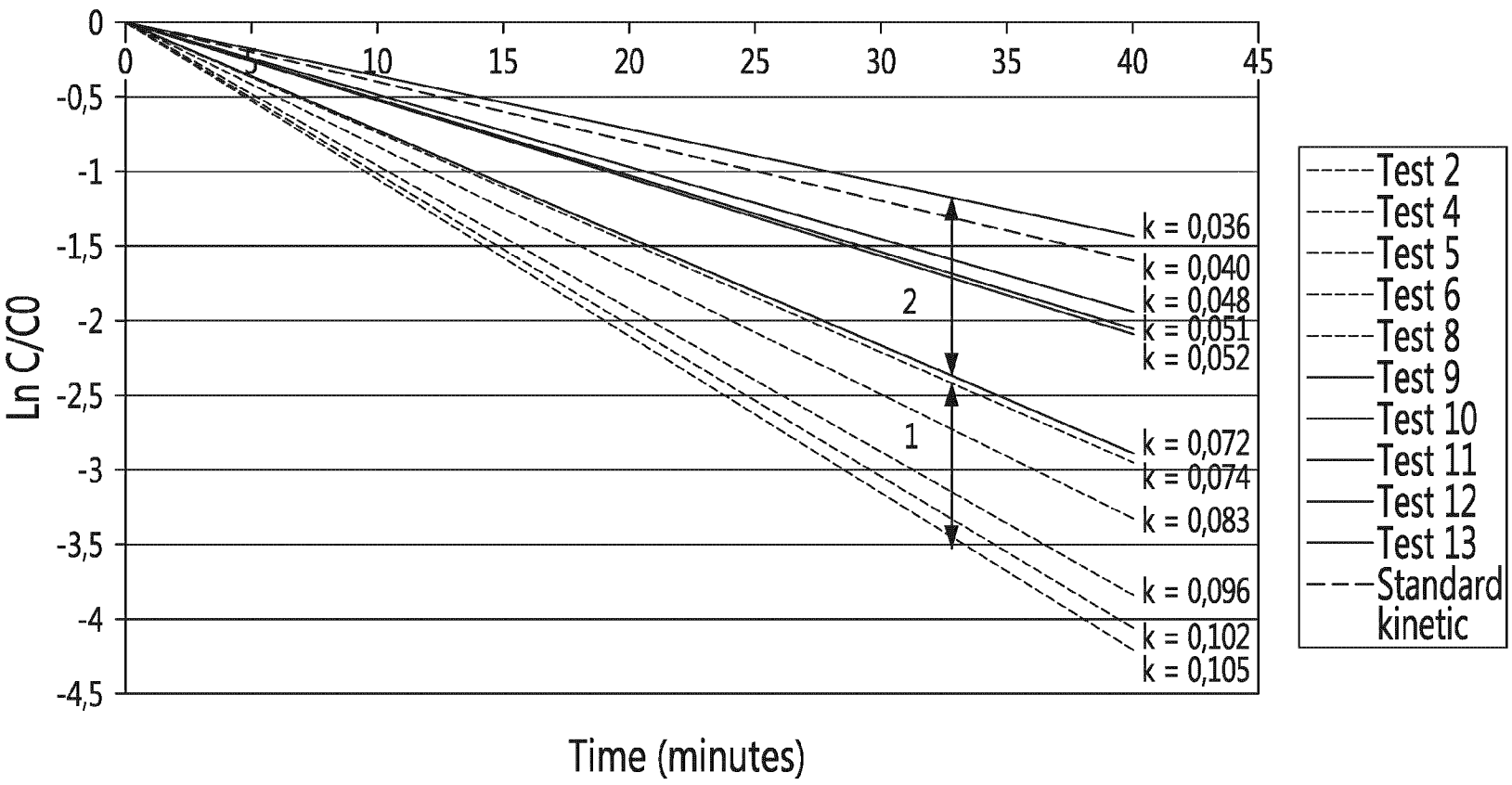
FIG. 20 is a graph showing experimental results.

The kinetic values are shown graphically in FIG. 20. The dashed lines in Section 1 represent the high kinetic values (Tests 1 to 8) and the full lines in Section 2 represent the kinetic values after Test 9 (Tests 9 to 13). The dashed line in Section 2 is the standard kinetic value used as reference.

Potential Reduction of the Fluxing Impact on the Overall Furnace Cycle

Based on historical data from the plant, it was found that fluxing at lower temperature earlier in the furnace cycle combined with the improved kinetics can reduce the impact of fluxing on furnace cycle time by 85%. Fluxing was performed during hot metal charging, alloying and other furnace operations.

Example 4

Other tests were made using an angle α of 6°. These tests appeared to demonstrate comparable shearing efficiency to the tests conducted at 10° or 12°.

CONCLUSIONS

It is believed that the broadening shape of the discharge portion 134 of the shaft 115 of the present apparatus (shown in FIG. 21B) with the sharp edges slows the speed of the gas during fluxing before exiting the shaft 115, which, in turn, favours the shearing effect of the impeller 116 in the illustrated embodiment, thereby improving the kinetics of the removal of the alkali in the molten metal.

Figure 22:
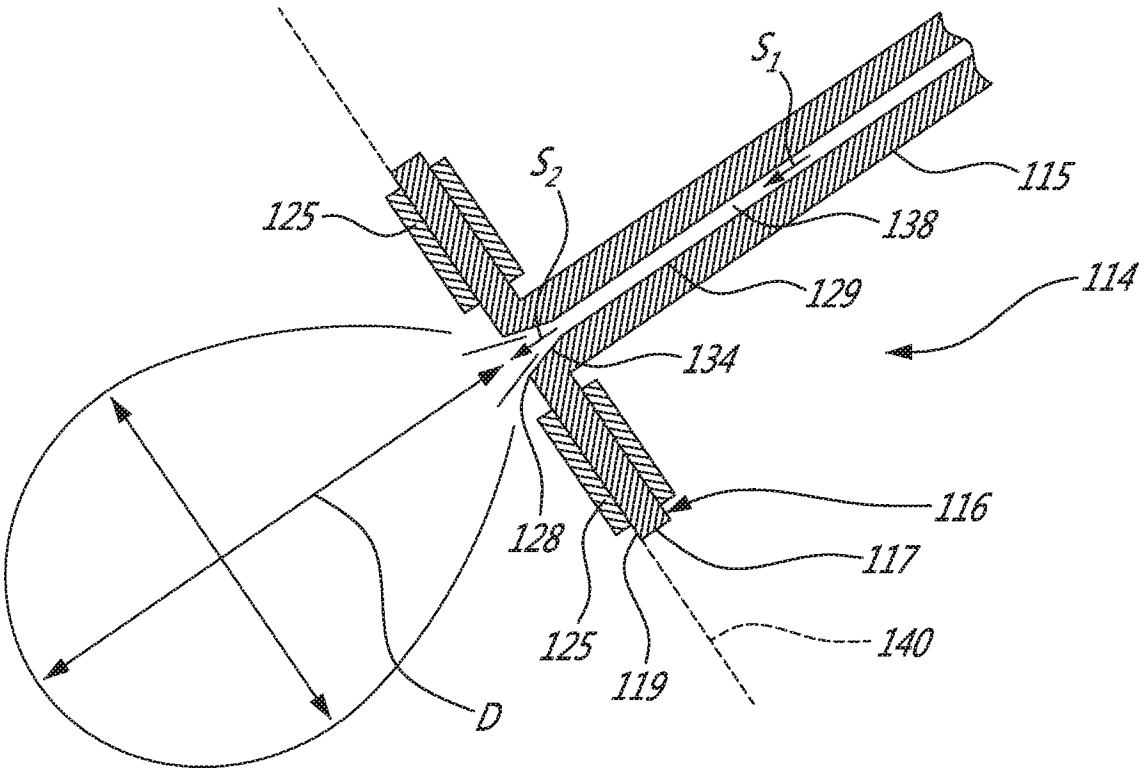
FIG. 22 is a schematic cross-sectional view of a rotary injector with a broadening discharge portion during use.

This is schematized in FIG. 22 where the speed of the particulate salts is of $S_1$ in the main portion 138 of the supply conduit 129, and slows down to $S_2$ at the outlet 128 of the discharge portion 134 due to the slowing of the carrier gas in this region, in accordance with fluid mechanic principles. Accordingly, the depth D of the 'cloud' of particulate material is reduced as compared to a scenario where the discharge portion would be continuously cylindrical with the main portion of the supply conduit (e.g. a scenario such as shown in FIGS. 4 and 21C). In turn, the particulate material in the 'cloud' having a lesser depth D is correspondingly closer to the impeller 116, thereby improving the shearing efficiency.

As exemplified above, tests demonstrated the potential gains in shear efficiency for angles α of between about 5° and 15°, and it is believed that a broader range of conicity angle can be workable within 0° and 90° range, such as up to 20° for instance.

Gains can also be obtained by the effect the broadening discharge portion can have on preventing metal plug blockages at low temperatures. More specifically, the broadening shape of the discharge portion of the shaft allows the use of the apparatus for fluxing metal at cold temperatures, for example ranging between 680 and 720° C., thereby increasing the efficiency of the overall casting center. Indeed, treating metal at colder temperatures allows fluxing to be carried out simultaneously with other furnace operations such as hot metal charging and/or prior to alloying. Due to clogging problems encountered in similar prior art apparatuses, fluxing could not be carried out at colder metal temperatures and was thus carried out after alloying of the molten metal.

The shaft may be made of any appropriate material, preferably graphite. Many types of graphite may be used, including combinations. For example, the tapered discharge portion of the shaft may be made in a first material and the remainder of the shaft may be made in a $2^{nd}$ material.

Persons skilled in the art, in the light of the instant disclosure, will readily understand how to apply the teachings of this disclosure to other applications where particulate solids or gasses are to be mixed in a liquid using a rotary injector. It is believed that the gains in shearing efficiency can readily be applied to processes involving introducing gas or particulate materials to other types of metals than aluminum, and even in introducing gas or particulate materials to materials other than metals altogether. For instance, the broadening discharge portion can be applied to oxygen lances for the treatment of steel, or in injecting air in sludge floatation cells in the mining industry.

In alternate embodiments, the length of the broadening discharge portion can vary. The length can vary as a function of the angle and of the size of the shaft. For instance, with a 15° angle, it would take a very big rotor to go deeper than about 3 inches. Moreover, tests have demonstrated limited effects of length on the results, the main effect stemming from the angle. On the other hand, if the gains associated to impeding blockages at low temperatures are sought, the length of the discharge portion should be of at least about the expected size of the metal plug which can be expected. In this logic, the required length is lesser when it is desired to operate the rotary injector at higher temperatures, and vice versa. To produce a rotary injector which is operable over a range of conditions, the length of the broadening discharge portion of the supply conduit can be made sufficient to tolerate the worst case scenario in terms of expected metal plug size, while factoring in desirable shearing efficiency. It is understood that the advantages of the broadening shape in impeding low temperature metal plug formation are associated with the corresponding expectable reduction in friction between the metal plug and the discharge portion of the supply conduit. More specifically, to expel a metal plug from a cylindrical discharge portion, the pressure differential across the plug must overcome the kinetic friction between the metal plug and the inner wall of the discharge portion, whereas this kinetic friction can be virtually eliminated by using a suitably shaped discharge portion. In the embodiments envisaged, the length of the broadening discharge portion is sufficient, at a given angle and shape, to allow speed reduction and a broadened jet to be ejected from the outlet in a manner to entrain and disperse the gas/flux mix efficiently in the shear zone.

In some embodiments, the length can be selected as a function of the scale and angle between the inlet end of the discharge portion and the axial outlet, and more specifically in a manner to obtain a ratio of surface between the inlet end of the discharge portion and the axial outlet of between 1.25 and 7.25. For instance, in a scenario where the diameter of the internal supply conduit is of ⅞" and corresponds to the diameter of the inlet end of the discharge portion, and with an angle of 7° from the axis between the inlet end of the discharge portion and the axial outlet, the axial length of the discharge portion can be between 0.5 and 6 inches; whereas in a scenario where the diameter of the internal supply conduit is of ⅞" and corresponds to the diameter of the inlet end of the discharge portion, and with an angle of 15° from the axis between the inlet end of the discharge portion and the axial outlet, the axial length of the discharge portion can be between 0.2 and 2.75 inches. In some embodiments, it can be preferred to maintain the ratio of surfaces between 3 and 5 rather than between 1.25 and 7.25.

Figure 13B:
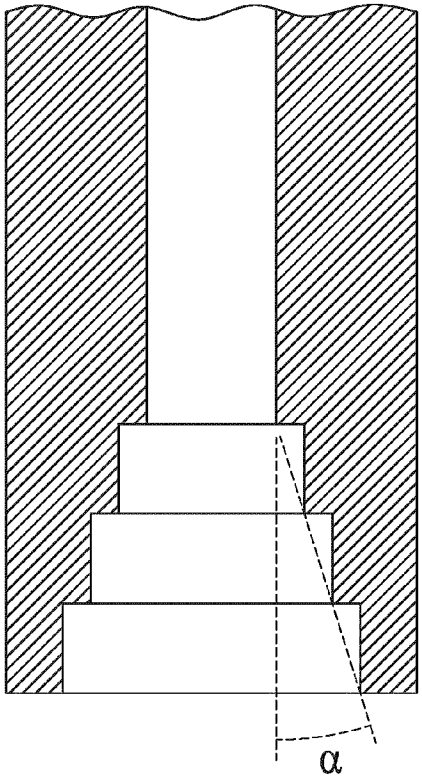
Figure 13C:
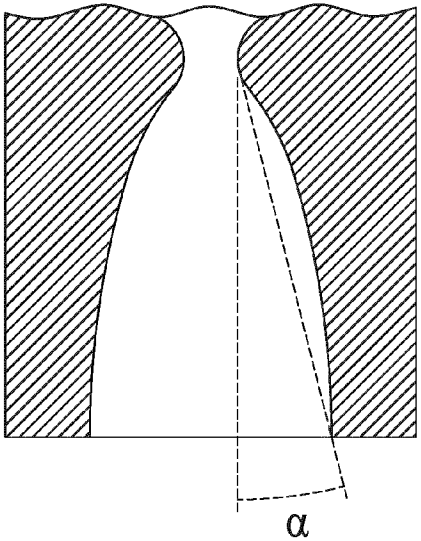

In alternate embodiments, the actual shape of the broadening discharge portion can vary while maintaining a generally broadening shape within workable ranges. FIGS. 13B and 13C show two specific examples each having an angle identified as angle $\alpha$. The embodiment shown in FIG. 13B has a plurality of successively broadening cylindrical stages. It will be understood that some or all of these stages can be conical rather than cylindrical in alternate embodiments. FIG. 13C offers another variant which is provided in a diffuser shape. In any event, care should be taken that any shoulder or feature in the designed or selected shape be adapted to impede adhesion of the mix to the internal faces following the Coanda effect. Moreover, care should be taken to avoid features which would otherwise impede the development of flow broadening or velocity reduction which may be required to achieve the desired effect.

As can be understood from the above, the examples described above and illustrated are intended to be exemplary only. For instance, in alternate embodiments, the shaft and impeller can be of a single component rather than two assembled components, the shaft can be of various lengths, and the broadening discharge portion can be made as part of the shaft, of the impeller, or partially as part of both the shaft and the impeller. The scope is indicated by the appended claims.

What is claimed is:

1. A process of treating molten aluminum using a rotary injector, the process comprising:

introducing a head of the rotary injector into the molten aluminum, the head of the rotary injector having an impeller with blades; and while the head of the rotary injector, including the blades, is maintained immersed in the molten aluminum and rotated, simultaneously:

entraining particulate treatment solids using a carrier gas along a supply conduit along a shaft of the rotary injector and out from an axial outlet of the head of the rotary injector, reducing a speed of the particulate treatment solids at a discharge portion of the supply conduit by an increase in a cross-sectional surface area of the supply conduit, and shearing the particulate treatment solids exiting the axial outlet by rotation of the blades.

2. The process of claim 1 wherein the process is performed in a furnace having a quantity of aluminum of between 10 and 150 tons.

3. The process of claim 1 wherein the introducing the head of the rotary injector is performed when the molten aluminum is at a temperature below 720° C.

4. The process of claim 3 wherein the temperature is below 700° C.

5. The process of claim 3 wherein the entraining particulate treatment solids is performed during hot metal charging of the molten aluminum.

6. The process of claim 3 wherein the entraining particulate treatment solids is performed prior to a step of alloying.

7. The process of claim 3 wherein the entraining particulate treatment solids is performed in parallel with other furnace operations.

8. The process of claim 3 wherein the process is performed during charging a last potroom crucible, once a quantity of aluminum has reached 90 tons.

9. The process of claim 1 wherein the entraining particulate treatment solids is performed during hot metal charging of the molten aluminum.

10. The process of claim 1 wherein the entraining particulate treatment solids is performed prior to a step of alloying.

11. The process of claim 1 wherein the entraining particulate treatment solids is performed in parallel with other furnace operations.

12. The process of claim 1 wherein the process is performed during charging a last potroom crucible, once a quantity of aluminum has reached 90 tons.

13. A process of treating molten aluminum using a rotary injector, the process comprising:

introducing a head of the rotary injector into the molten aluminum;

while the head of the rotary injector is in the molten aluminum, entraining particulate treatment solids along a supply conduit along a shaft of the rotary injector and out from the head of the rotary injector, while rotating an impeller at the head of the rotary injector, and;

reducing a speed of the particulate treatment solids at a discharge portion of the supply conduit by an increase in a cross-sectional surface area of the supply conduit;

wherein the entraining the particulate treatment solids is performed during hot metal charging of the molten aluminum.

14. The process of claim 13 wherein the introducing the head of the rotary injector is performed when the molten aluminum is at a temperature below 720° C.

15. A process of treating molten aluminum using a rotary injector, the process comprising:

introducing a head of the rotary injector into the molten aluminum;

while the head of the rotary injector is in the molten aluminum, entraining particulate treatment solids along a supply conduit along a shaft of the rotary injector and out from the head of the rotary injector, while rotating an impeller at the head of the rotary injector, and;

reducing a speed of the particulate treatment solids at a discharge portion of the supply conduit by an increase in a cross-sectional surface area of the supply conduit;

wherein the process is performed during charging a last potroom crucible, once a quantity of aluminum has reached 90 tons.

16. The process of claim 15 wherein the introducing the head of the rotary injector is performed when the molten aluminum is at a temperature below 720° C.

17. A rotary injector comprising an elongated shaft having a proximal end and a distal end, and an impeller at the distal end of the elongated shaft, the elongated shaft and the impeller being collectively rotatable during operation around an axis of the shaft, the rotary injector being hollow and having an internal supply conduit extending along the shaft and through the impeller, the supply conduit having an inlet at the proximal end of the shaft, a main portion extending from the inlet to a discharge portion, the discharge portion extending to an axial outlet, the discharge portion having a narrow end connecting the main portion of the supply conduit and a broader end at the axial outlet; wherein the impeller has a distal face opposite the shaft, and blades protruding axially from the distal face, the blades being external to and surrounding the axial outlet.

18. The rotary injector of claim 1 wherein the discharge portion has a truncated conical shape.

19. The rotary injector of claim 18 wherein the axial outlet has a sharp edge.

20. The rotary injector of claim 1 wherein the axial outlet has a sharp edge.

21. The rotary injector of claim 1 wherein the discharge portion has an angle of between about 5 and 20° relative the shaft axis.

22. The rotary injector of claim 21 wherein the discharge portion has an angle of between 5 and 15° relative the shaft axis.

23. The rotary injector of claim 1 wherein the discharge portion has a length of about 3 inches along the shaft axis.

24. The rotary injector of claim 1 wherein a surface ratio of an upstream end of the discharge portion and the axial outlet is between 1.25 and 7.25.

25. The rotary injector of claim 1 wherein the impeller is provided in the form of a distinct component from the shaft and is removable therefrom.

26. The rotary injector of claim 25 wherein the distal end of the shaft and the impeller are matingly engaged to one another via corresponding male and female threads.

27. The rotary injector of claim 1 wherein the shaft and the impeller are made of graphite.

28. The rotary injector of claim 1 wherein when the rotary injector is used to treat molten metal, the axial outlet is directly exposed to the molten metal.

29. The rotary injector of claim 1 wherein the discharge portion and supply conduit are used to feed particulate treatment solids when the rotary injector is used to treat molten metal and are empty prior to said use.

30. The rotary injector of claim 1 wherein the distal face of the impeller is a radially-extending surface.

31. The rotary injector of claim 30 wherein the distal face of the impeller is oriented perpendicular to the axis of the shaft.

32. The rotary injector of claim 1 wherein the blades extend axially beyond the axial outlet of the supply conduit.

* * * * *